United States Patent [19]

Sweers et al.

[11] Patent Number: 4,606,156

[45] Date of Patent: Aug. 19, 1986

[54] ACCESS FLOORING PANEL

[75] Inventors: Kenneth M. Sweers, Grand Rapids; G. Jack Cooper, Alto; R. Jack Munsey, Caledonia, all of Mich.

[73] Assignee: C-Tec, Inc., Grand Rapids, Mich.

[21] Appl. No.: 519,468

[22] Filed: Aug. 4, 1983

[51] Int. Cl.[4] ..... E04B 2/28

[52] U.S. Cl. ..... 52/126.6; 52/263; 52/386; 52/673

[58] Field of Search ..... 52/598, 599, 386, 376, 52/673, 334, 126.6, 263, 674, 675

[56] References Cited

U.S. PATENT DOCUMENTS

| | | | |
|---|---|---|---|
| 165,781 | 7/1875 | Baker | 52/599 |
| 800,655 | 10/1905 | Kitsee | 52/386 |
| 830,313 | 9/1906 | Fenn | 52/386 |
| 1,335,384 | 3/1920 | Meyers | 52/598 |
| 1,845,711 | 2/1932 | Honig et al. | |
| 1,915,896 | 6/1933 | Maul | |
| 2,086,525 | 7/1937 | Akers | |
| 2,104,506 | 1/1938 | Coddington | 52/599 X |
| 2,154,036 | 4/1939 | Doherty | |
| 3,074,505 | 1/1963 | Schultz | 52/376 X |
| 3,192,672 | 7/1965 | Heuer | |
| 3,759,009 | 9/1973 | Ransome | |
| 4,044,522 | 8/1977 | Strumer et al. | 52/599 |
| 4,251,970 | 2/1981 | Home | 52/724 X |
| 4,447,998 | 5/1984 | Griffin | 52/802 X |
| 4,505,449 | 3/1985 | Turner et al. | 52/126.6 X |

FOREIGN PATENT DOCUMENTS

| | | | |
|---|---|---|---|
| 123682 | 3/1931 | Austria | 52/673 |
| 1017522 | 9/1977 | Canada | 52/263 |
| 552294 | 5/1932 | Fed. Rep. of Germany | 52/673 |
| 747939 | 3/1944 | Fed. Rep. of Germany | 52/599 |
| 2545854 | 10/1976 | Fed. Rep. of Germany | 52/126.6 |
| 1271586 | 8/1961 | France | 52/673 |
| 1364906 | 4/1964 | France | 52/263 |
| 601449 | 1/1960 | Italy | 52/599 |
| 23632 | 12/1961 | Japan | 52/599 |
| 70265 | 6/1952 | Netherlands | 52/673 |
| 54223 | 7/1934 | Norway | 52/673 |
| 371579 | 10/1963 | Switzerland | 52/598 |
| 447568 | 3/1968 | Switzerland | 52/126.6 |
| 17556 | of 1903 | United Kingdom | 52/724 |
| 554481 | 7/1943 | United Kingdom | 52/599 |

*Primary Examiner*—Henry E. Raduazo
*Assistant Examiner*—Richard E. Chilcot, Jr.
*Attorney, Agent, or Firm*—Price, Heneveld, Huizenga & Cooper

[57] ABSTRACT

The specification discloses an access flooring panel having improved load-bearing strength and a relatively simple construction. The panel includes a generally planar metal pan and a concrete core cast thereon. The pan includes a plurality of tabs encapsulated within the concrete and bent upwardly from the pan and radially inwardly with respect to the panel. Consequently, radially outwardly directed horizontal shear forces exerted on the tabs by the core when loads are placed on the panel exert a pushing, rather than a pulling or tearing, force on the tabs. In a preferred embodiment, the pan includes an integral side wall and return flange extending about the core to protect the core and to strengthen the panel.

23 Claims, 5 Drawing Figures

ACCESS FLOORING PANEL

BACKGROUND OF THE INVENTION

The present invention relates to floor panels, and more particularly floor panels including a metallic pan and a cementitious material cast thereon.

A wide variety of access floor systems have been developed to provide a functional floor elevated above the structural floor of a building. Such systems were initially developed to provide a means of easily installing and subsequently accessing the large quantities of power and communications cable required in computer installations. These systems are now used in a host of environments enabling heating, cooling, and ventilating equipment; communications equipment and cables; and electrical distribution systems to be conveniently and accessibly located beneath the access floor.

Generally, an access floor system includes a plurality of floor panels supported on pedestals resting on the structural floor. In the most popular floors, each panel is two feet square and supported at each of its four corners on a pedestal which also supports one corner of the three adjacent panels. Optionally, grid channels or stringers are installed between the pedestals to provide lateral stability and increased strength to the system. In highly elevated systems (e.g., greater than 18 inches) additional lateral bracing is included and coupled to one or both of the pedestals and grid channels.

The floor panels used in such systems have a variety of constructions. One such panel comprises a planar high-density composite core and galvanized steel sheets laminated to the opposite core surfaces. Perimeter channels are welded to the steel cover sheets to provide an extremely serviceable panel. However, this panel utilizes combustible materials and has a relatively high cost-to-strength ratio.

Other types of panels used in other than access flooring environments include a planar cementitious core and metal cover sheets secured to one or both sides thereof. Examples of such constructions are illustrated in U.S. Pat. Nos. 3,759,009, entitled COMPOSITE LOAD BEARING PANELS, issued Sept. 18, 1973, to Ransome; 2,154,036 entitled CONSTRUCTIONAL FINISH DETAIL ELEMENT, issued Apr. 11, 1939, to Doherty; and 1,845,711, entitled TILE AND FLOOR WITH SPECIAL METAL WEARING SURFACE, issued Feb. 16, 1932, to Honig. However, these panels are also not without their drawbacks. Perhaps most significantly, known constructions for interconnecting the metal covers and cementitious cores are unsatisfactory, and more particularly are relatively expensive and/or structurally weak and unsuitable for access flooring.

In the Doherty device, a metal lath is welded to the metal pan prior to the casting of the cementitious material such that the lath secures the pan to the core in the completed article. However, this construction appears to be relatively labor intensive, and consequently relatively expensive. The Ransome and Honig devices include a plurality of tabs lanced from the planar sheet to be encapsulated tabs are oriented in a generally common direction over the entire tabs Honig are formed in a variety of directions all perpendicular to the edges of the square sheet. The cementitious material shifts or slides against the metal cover when loads are placed on the panels, which movement exerts horizontal shear forces on the tabs extending into the core material.

More specifically, the cementitious core exerts an outwardly directed shear force from the center of the panel when a load is placed directly on the panel. Therefore, a portion of the tabs formed by lancing the pan generally away from the center of the panel are ripped or torn from the metal pan under this horizontal shear force. Such movement greatly detracts from the strength and integrity of the panel, leading to cracking of the cementitious core, excessive flexing of the panel, or even collapse.

SUMMARY OF THE INVENTION

The aforementioned problems are solved by the present invention. Essentially, a composite floor panel is provided comprising a lanced metal pan wherein the tabs are oriented to prevent tearing and ripping. The tabs extend into an overlying cementitious material to anchor the pan and core together, preventing relative slippage when subjected to shear forces. Each tabs is formed by lancing the metal pan and bending the lanced portion generally radially inwardly toward a central portion of the pan. Consequently, when vertical forces are placed on the panel, the radially outwardly directed shear force exerted on the tabs by the cementitious material pulls the tabs radially outwardly and does not rip the tabs from the pan as in known structures. The pan and core act as a composite structurally--the metal pan providing the tensile strength and the cementitious core providing the compressive strength.

In a first more restrictive aspect of the invention, the panel is generally square and includes four quadrant portions, one adjacent each corner. The tabs within each quadrant are oriented in a generally common direction facing the center portion of the panel. Such a construction has both the compressive and tensile strength advantages of the previously described embodiment, particularly because the tabs face away from the corners of the panel at which the panel is supported.

In a second more restrictive aspect of the invention, the pan includes an integral peripheral side wall extending upwardly from the pan about the cementitious core. The peripheral side wall includes a plurality of tabs extending into the cementitious material to further improve the structural rigidity of the panel and to prevent buckling of the side wall.

In yet another aspect of the invention, the pan includes an integral side wall and return flange surrounding the concrete core to protect the edge of the core and to strengthen the panel. Specifically, the return flange adds compressive strength to the edge of the composite and reduces the possibility of the side wall buckling.

Accordingly, the panel of the present invention provides a relatively low-cost structure having improved strength and life over previously known constructions. In particular, the panel construction greatly reduces any possibility of pan and core separation under load.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 1:
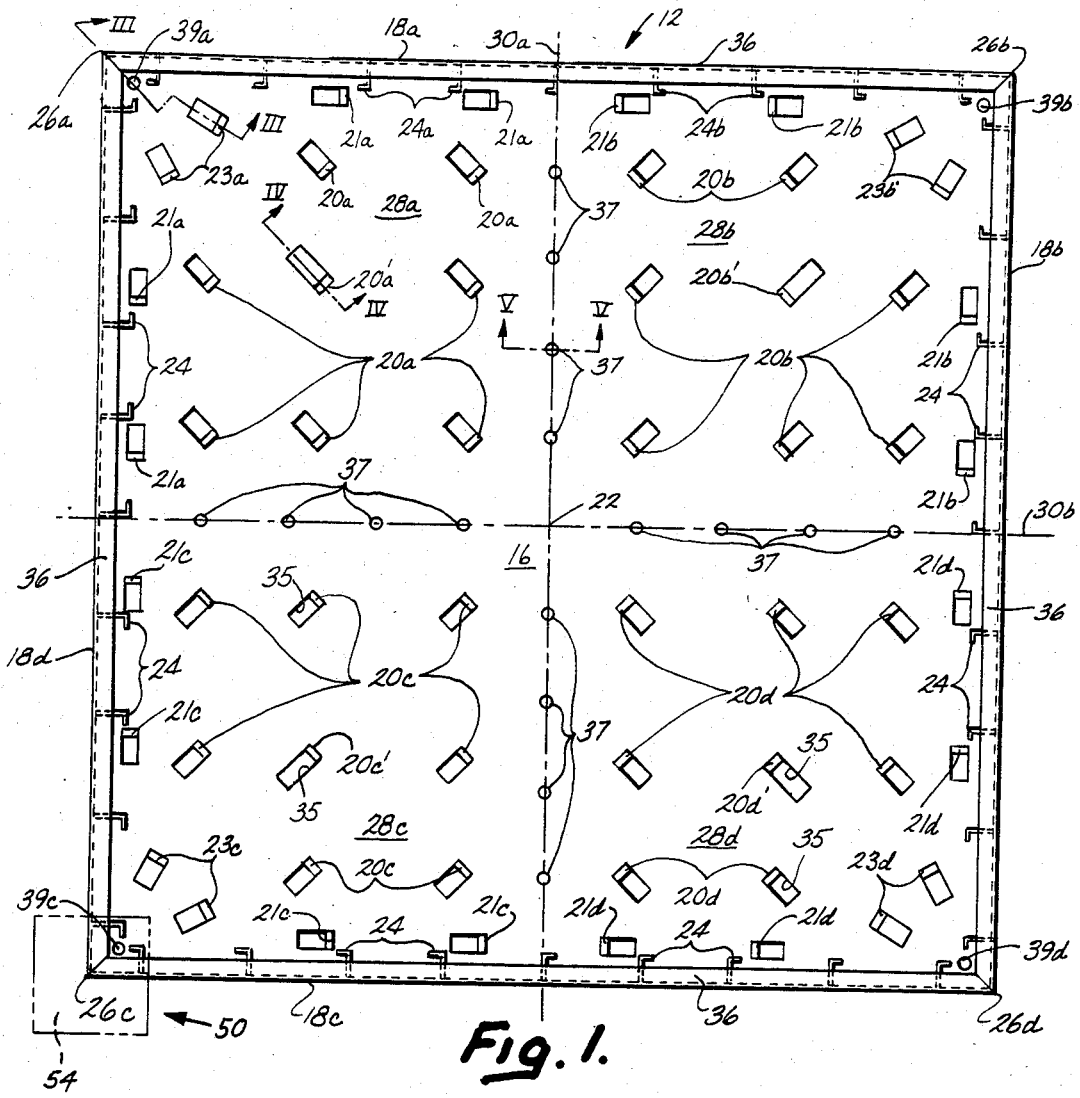
FIG. 1 is a top plan view of the pan of the floor panel of the present invention.
Figure 2:
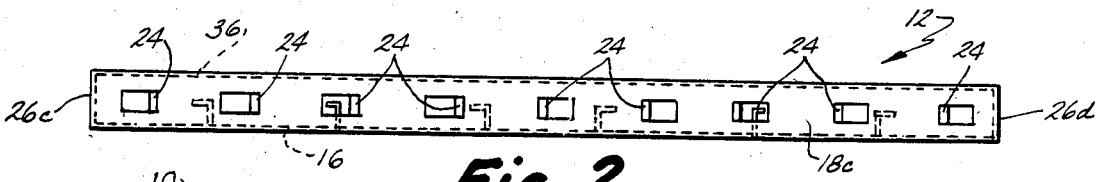
FIG. 2 is a side elevation view of the pan.

Access floor panel 10 constructed in accordance with a preferred embodiment of the invention includes metal pan 12 (FIGS. 1–3) and cementitious material 14 (FIG. 3) cast thereon. Pan 12 includes bottom 16 and peripheral side wall 18 extending upwardly therefrom. A plurality of angled tabs 20, peripheral tabs 21, and corner tabs 23 are formed in pan 12 by lancing the pan and bending the resultant lanced portion generally toward center area 22 of the pan, thus anchoring the pan to core 14. Side wall 18 also includes a plurality of tabs 24 extending outwardly over pan bottom 16 to anchor the side walls to core 14.

Turning more specifically to the construction of the elements of floor panel 10, pan 12 (FIGS. 1 and 2) is fabricated from a single sheet of galvanized steel which in the preferred embodiment is 20-gage to 26-gage. Pan 12 is generally square in plan view (FIG. 1) and includes four corners 26*a, b, c,* and *d.* Pan bottom 16 is generally planar and includes four quadrants or areas 28*a, b, c,* and *d* separated by imaginary center lines 30*a* and 30*b.*

Each of quadrants 28*a, b, c,* and *d* includes a plurality of, and in the preferred embodiment eight, tabs 20*a, b, c,* and *d,* respectively. All of the tabs 20 within a particular quadrant 28 are oriented in a generally common direction, which in the preferred embodiment is generally away from the associated quadrant corner 26 and generally radially inwardly toward the center 22 of pan 12. As used herein, "generally radially inwardly" means any orientation inclined more toward the center 22 than a tangential orientation. Most preferably, each of tabs 20 is angularly offset 45° from side walls 18 of square pan 12.

Each quadrant 28 also includes a plurality of, and in the preferred embodiment four, peripheral tabs 21. Two of tabs 21 are adjacent or closely proximate each of the two sides walls 18 defining the associated quadrant 28. As with tabs 20, tabs 21 are oriented to extend upwardly away from the associated quadrant corner 26; however, tabs 21 are generally parallel to side walls 18.

Each quadrant 28 also includes a plurality of, and in the preferred embodiment two, corner tabs 23 closely proximate the associated quadrant corner 26. As with tabs 20, tabs 23 are oriented to extend upwardly away from the associated corner 26. Preferably, tabs 23 are angularly offset approximately 30° from the adjacent pan side wall 18.

Figure 3:
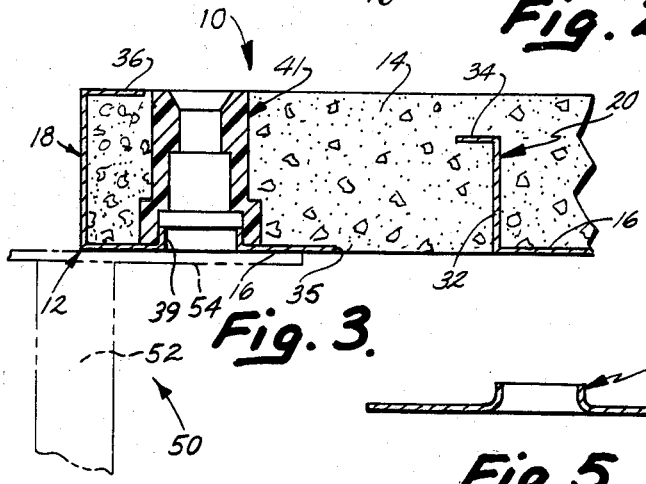
FIG. 3 is a sectional view taken along plane III—III in FIG. 1 after the cementitious material is cast in the pan.
Figure 4:
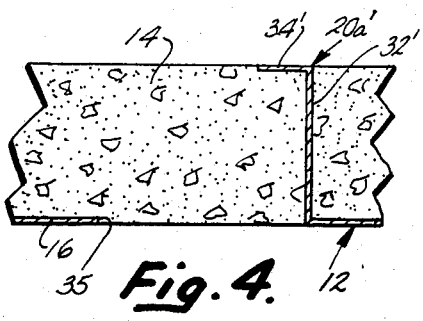
FIGS. 4 and 5 are sectional views taken along planes IV—IV and V—V, respectively, in FIG. 1.

Each of tabs 20, 21, and 23 is generally identical to the others with the exception of lances 20*a'*, 20*b'*, 20*c'*, and 20*d'* and is most clearly illustrated in FIG. 3. Each tab is generally L-shaped including leg 32 extending generally perpendicularly upwardly from pan 12 and foot 34 extending generally perpendicularly from the leg. Each leg 32 is shorter than side wall 18 and core 14 so that foot 34 is embedded within the core in the finished product. Tabs 20*a'*, 20*b'*, 20*c'* and 20*d'* differ from the tabs previously described in that their legs 32' (FIG. 4) are generally the same height as side wall 18 and core 14 so that foot 34' is exposed through the core in the finished product. The formation of tab 20 or 21 creates tab aperture 35. A tab is said to face or extend in a direction defined by the orientation of the tab with respect to its associated tab aperture.

Figure 5:
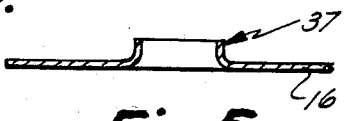

Circular extrusions 37 (FIGS. 1 and 5) extend from pan bottom 16 along center lines 30 to further prevent relative slippage between core 14 and pan 12. Alternatively, extrusions 37 can be formed by piercing and can be arranged on additional or substitute areas of pan bottom 16--for example, interspersed among tabs 20.

One corner hole extrusion 39 (FIGS. 1 and 3) extends from pan bottom 16 adjacent or closely proximate each corner 26. Extrusions 39 are generally similar to extrusions 37 and can also be formed by piercing pan 12. As most clearly seen in FIG. 3, extrusion 39 positions and supports a generally tubular insert 41 to receive tie-down bolts in the finished product. When tie-down bolts (not shown) are used to secure panels 10 to a pedestal 50 (phantom), the need for stringers between pedestals is often eliminated.

Side wall 18 is integral with and extends upwardly from pan bottom 16. More particularly, side wall 18 includes four side wall sections 18*a, b, c,* and *d* extending between corners 26. Top flange or return 36 extends inwardly from side wall 18 parallel to pan bottom 16 defining a 90 degree upper edge to panel 10 and preventing edge chipping of cementitious material 14. Top flange 36 additionally reinforces side wall 18 to reduce buckling of the side wall and to provide additional compressive strength to panel 10. For additional strength, top flanges 36 can be welded at corners 26.

A plurality of tab 24 is formed in each of side wall sections 18. Each tab 24 is generally identical to tabs 20 previously described and is bent outwardly over pan bottom 16 and toward the center of its associated side wall 18. For example, tabs 24*a* and 24*b* are oriented opposite one another, however, both extending toward center line 30*a*.

Cementitious material 14 preferably is lightweight and has a density of approximately 70 to 100 pounds per cubic foot, and most preferably 80 pounds per cubic foot. One suitable cementitious mixture will be described herein. However, the scope of the invention is not restricted by the particular cementitious material used. The preferred concrete mix 14 is made by combining 658 pounds of cement with 1530 pounds of HAYDITE mix aggregate and then adding 336 pounds of water and 15 pounds of a foam such as that sold under the mark CELCORE by Florida Celcore Inc. of Fort Lauderdale, Fla. Any lightweight aggregate mix, and particularly a heat expanded shale, can be substituted for the particular HAYDITE mix specified. The resultant concrete mix 14 has a density of approximately 80 pounds per cubic foot and comprises approximately 12 to 15 percent air due to the presence of the foam. Optionally, plastic or steel fibers can be included in the mix. One suitable plastic fiber is that sold under the mark FORTA FIBER by Forta-Fiber Inc. of Grove City, Pa., and is preferably combined with the mix in the ratio of approximately 5.4 pounds per cubic yard. One suitable steel fiber is that sold under the mark FIBERCON by U.S. Steel Corp. of Pittsburgh, Pa., and is preferably combined with the mix in the ratio of approximately 125 pounds per cubic yard.

MANUFACTURE AND OPERATION

Panel 10 is fabricated by first forming panel pan 12. More particularly, the panel pan is stamped from 20-gage to 26-gage galvanized steel stock. Tabs 20, 21, 23, and 24 are then formed by lancing the pan and bending each tab 20 therefrom to form leg 32 and foot 34. Circular extruded holes are also formed in pan 12. Optionally, pan 12 is stamped and tabs 20, 21, 23, and 24 are formed in a single stamping operation. Edge flange 36 is bent upwardly from side wall 18 to define a 90 degree upper edge for pan 12, and side wall sections 18 are bent upwardly from pan bottom 16 to define perimeter side wall 18. Optionally, top flanges 36 can be hemmed and/or welded together at corners 26; and one insert 41 is positioned over each corner extrusion 39. Concrete mix 14 is then poured or cast into pan 12 encapsulating all of tabs 20, 21, 23, and 24, except for tabs 20*a'*, 20*b'*, 20*c'*, and 20*d'*, which are exposed through core 14. The concrete is poured to a depth even with top flange 36 (see FIG. 3) to provide a smooth cementitious surface generally coplanar with the top flange. As the concrete mix sets or hardens, tabs 20, 21, 23, and 24 tightly secure pan 12 to core 14. Additionally, the tabs tab apertures 35, and circular extrusions 37 prevent relative slippage of core 14 and pan bottom 16 under shear forces. The panels 10 are used to create an access floor by positioning the panels on pedestals 50 (see FIGS. 1 and 3). The pedestals are well-known to those having ordinary skill in the access flooring art and include a post 52 supporting a pad 54 above a structural floor (not shown). The pedestals 50 are arranged on the floor so that each pad 54 supports a corner of each of four adjacent panels. Consequently, the panels 10 are supported above a structural floor on the pedestals 50.

In use, with the exposed concrete facing upwardly, the orientation of tabs 20 insures that the tabs will not be ripped or torn from pan 12 by flexure of the panel under loads imposed thereon. More particularly, a load imposed vertically on panel 10, and more particularly on concrete 14, causes the panel to tend to flex downwardly from the support provided at corners 26 and/or perimeter walls 18 by pedestals and stringers (not shown). As the panel tends to flex, concrete 14 tends to shift or moves radially outwardly against pan 12 generally from center 22 toward corners 26 exerting a horizontal shear force on tabs 20. Because the forces on tabs 20 are radially outwardly, the tabs simply pull on bottom 16 and retain the pan and core tightly together. On the other hand, if tabs 20 were oriented generally radially outwardly, the tabs would rip or tear from pan bottom 16 under the horizontal shear force. Tabs 21 perform a similar function along side wall 18 to further strengthen the interconnection of pan 12 and core 14. Accordingly, panel 10 of the present invention provides a construction wherein the pan 12 and concrete 14 remain tightly bonded together to improve the strength and life of the panel and to reduce the deflection of the panel. Tabs 20*a'*, 20*b'*, 20*c'*, and 20*d'* are exposed through core 14 (see FIG. 4) to facilitate surface electrical conductivity of the panel.

Tabs 24 function similarly to tabs 20 and 21 to prevent side walls 18 from buckling. Because the tabs face the center of each side wall 18, the radially outwardly directed force exerted on the tabs by concrete 14 pulls the tabs rather than ripping them to insure that the side wall does not separate from the concrete. This construction prevents side walls 18 from bending or buckling and further insures the structural rigidity of the panel.

Panel 10 of the preferred embodiment will support 300 pounds per square foot. A spot load of 1200 pounds per square inch at any point on the panel surface will produce less than 0.080 inch deflection. Other panels of various strengths can be fabricated by varying the gage of pan 12, the mix of core 14, or the panel thickness at discrete locations such as the edges.

The above description is that of a preferred embodiment of the invention. Various changes and alterations can be made without departing from the spirit and broader aspects of the invention as set forth in the appended claims, which are to be interpreted in accordance with the principles of patent law, including the doctrine of equivalents.

The embodiments of the invention in which an exclusive property or priviledge is claimed are defined as follows:

1. An access flooring kit comprising:

pedestal means for supporting access flooring panels above a structural floor; and a plurality of composite access flooring panels to be removably supported on said pedestal means above the structural floor, each of said panels comprising a rectangular pan and a cementitious core substantially overlying said pan whereby said pan is between said core and said pedestal means when said panel is supported on said pedestal means, said pan including a plurality of integral lanced tabs extending therefrom into said core to mechanically bond said core and said pan, each of said tabs forming an aperture radially outward of the tab, each of said tabs being angularly offset from the peripheral edges of said pan whereby horizontal sheer forces exerted radially outwardly on said tabs by said core under a downward force on the center of said panel will not tend to enlarge said apertures or rip said tabs from said pan.

2. A flooring panel as defined in claim 1 wherein said pan comprises a plurality of areas each including at least one of said tabs, the tabs within any one area being oriented in a generally common direction.

3. A flooring panel as defined in claim 2 wherein said areas comprise quadrants.

4. A flooring panel as defined in claim 3 wherein said pan is generally square, and wherein said common direction is generally 45° offset from the sides of said pan.

5. A flooring panel as defined in claim 1 wherein said pan includes a generally planar bottom and an integral peripheral side flange portion extending upwardly therefrom and surrounding said cementitious core.

6. A flooring panel as defined in claim 5 wherein said side flange portion includes second lanced tabs extending into said cementitious core for securing said side flange portion to said cementitious material.

7. A flooring panel as defined in claim 6 wherein each of said second tabs is bent inwardly from said side flange portion toward a center thereof.

8. A flooring panel as defined in claim 6 further comprising a top flange extending inwardly over said core from said side flange to protect said core and to add compressive strength to said panel.

9. A flooring panel as defined in claim 1 wherein said pan further includes a plurality of generally circular projections extending therefrom into said core to further reduce relative slippage of said pan and said core.

10. A flooring panel as defined in claim 1 wherein each of said tabs is generally L-shaped.

11. An access floor comprising:

pedestal means for supporting an access floor panel above a structural floor; and a composite access floor panel removably supported on said pedestal means above the structural floor, said panel comprising a generally planar rectangular pan having a plurality of integral lanced tabs extending upwardly therefrom, said pan including a central portion, selected ones of said tabs being bent from said pan in a direction generally toward said pan central portion, each of said selected tabs being angularly offset from the pan periphery and forming an aperture generally opposite the tab from said central portion of said pan; and a cementitious core cast over said pan whereby said pan is between said core and said pedestal means when said panel is supported on said pedestal means, said core encapsulating said tabs to mechanically bond said core and said pan whereby the radially outwardly directed shear force exerted on said tabs during flexing of the panel will not tend to enlarge said apertures.

12. A floor panel as defined in claim 11 wherein said direction is generally radially inwardly.

13. A floor panel as defined in claim 12 wherein said pan includes a plurality of areas, and wherein all selected tabs within any one of said areas are oriented in a generally common direction.

14. A floor panel as defined in claim 13 wherein said pan is generally square, and wherein said areas comprise quadrants.

15. A floor panel as defined in claim 11 wherein said tabs are generally L-shaped.

16. A floor panel as defined in claim 11 further comprising a peripheral side wall integral with said pan and bent upwardly therefrom adjacent said cementitious core.

17. A floor panel as defined in claim 16 wherein said peripheral side wall also includes lanced tabs extending into said cementitious material.

18. A floor panel as defined in claim 17 further comprising a top flange integral with said side wall and bent inwardly therefrom about said cementitious core.

19. A floor panel as defined in claim 11 wherein said pan further includes a plurality of generally circular projections extending therefrom into said cementitious core to further reduce relative slippage of said pan and said core.

20. An access floor comprising:

support means for supporting access floor panels; and a plurality of composite access floor panels removably supported on said support means above the structural floor, each of said floor panels comprising a generally square one-piece metal pan including a generally planar bottom and an integral peripheral side wall extending upwardly therefrom, said bottom including a plurality of integral lanced tabs extending upwardly therefrom and away from the corner nearest each tab thereby forming an aperture between each tab and its nearest corner, said tabs being angularly offset from the pan sidewalls; and concrete cast over and within said pan and encapsulating said tabs to mechanically bond said core and said pan, said concrete being above said pan bottom when said panels are on said support means.

21. An access floor panel as defined in claim 20 wherein each of said tabs is generally L-shaped to improve its securement within said concrete.

22. An access floor panel as defined in claim 20 wherein said peripheral side wall includes a plurality of second lanced tabs extending into said concrete to secure the side wall to the concrete.

23. An access floor panel as defined in claim 22 wherein said side wall comprises four side wall sections one each secured to each edge of said square pan, and wherein the tabs in each of said side wall sections are bent toward the midpoint of said each side wall section.

* * * * *

UNITED STATES PATENT AND TRADEMARK OFFICE

CERTIFICATE OF CORRECTION

PATENT NO. : 4,606,156

DATED : August 19, 1986

INVENTOR(S) : Kenneth M. Sweers et al

It is certified that error appears in the above-identified patent and that said Letters Patent is hereby corrected as shown below:

Column 1, line 62;
After "encapsulated" insert --within the cementitious material. The--.

Column 1, line 62;
After "tabs" insert --in Ransome--.

Column 1, line 64;
After "entire" insert --surface of the cover (see Fig. 3); while the--.

Column 1, line 64;
After "tabs" insert --in--.

Column 2, line 20;
"tabs" should be --tab--.

Column 5, line 18;
After "tabs" insert --,--.

Signed and Sealed this

Thirty-first Day of March, 1987

*Attest:*

*Attesting Officer*

DONALD J. QUIGG

*Commissioner of Patents and Trademarks*